United States Patent [19]

Bolton

[11] 4,308,077

[45] Dec. 29, 1981

[54] CONSTANT FLOW FELT DEWATERING SYSTEM

[75] Inventor: Joseph A. Bolton, Glens Falls, N.Y.

[73] Assignee: Albany International Corp., Menands, N.Y.

[21] Appl. No.: 100,617

[22] Filed: Dec. 6, 1979

[51] Int. Cl.[3] ..... B08B 7/00

[52] U.S. Cl. ..... 134/15; 15/306 A; 134/18; 134/21; 162/199; 162/252; 162/279; 162/364; 162/366

[58] Field of Search ..... 162/199, 252, 279, 366, 162/274, 364, 253; 134/15, 18, 21, 122 R, 124; 15/306 A

[56] References Cited

U.S. PATENT DOCUMENTS 2,479,031 8/1949 Tait ..... 162/252

3,859,163 1/1975 Haythornthwaite ..... 162/279

FOREIGN PATENT DOCUMENTS 565964 7/1977 U.S.S.R. ..... 162/279

*Primary Examiner*—Peter Chin

*Attorney, Agent, or Firm*—Kane, Dalsimer, Kane, Sullivan and Kurucz

[57] ABSTRACT

A constant flow felt dewatering system including first and second suction pipes with a slot in each pipe. A felt is positioned to pass over the slots of the first and second pipes. A centrifugal exhauster is connected by conduits to the first and second suction pipes. Drive structure is provided to operate the centrifugal exhauster and apply suction to the first and second suction pipes and to advance the felt over the pipes whereupon suction is applied thereto to dewater the felt. Controls are responsive to change in felt conditions to vary the dwell time of the felt with respect to the slots in order to maintain a substantially constant flow.

16 Claims, 4 Drawing Figures

CONSTANT FLOW FELT DEWATERING SYSTEM

BACKGROUND OF THE INVENTION

In conventional suction pipe systems in the papermaking industry it is standard to use a suction pipe with an elongated slot in alignment with a felt. The suction pipe is positioned so that the felt passes over the slot and when the appropriate pressure differential is produced the felt will be dewatered, the water being drawn into the suction pipe and directed to an appropriate collection location. A conventional separator is used when water is to be separated from air in the system and the air is exhausted in a well known manner.

There are several basic types of vacuum pumps used for providing the most efficient vacuum system for different types of papermaking machine applications. Three basic types of vacuum pumps used in the paper industry are the liquid ring pump, the positive displacement pump, and the centrifugal exhauster, sometimes called a blower. Each type has its advantages and disadvantages over one another, plus different maximum efficiency values on air flow versus vacuum settings. Therefore, it is important to select not only a particular type of vacuum pump for a given application, but also with size, port openings, number of stages, and other criteria, for the lowest horsepower for unit air flow requirement. Lower horsepower naturally reduces manufacturing, assembly and use costs as well as producing lower energy consumption which is of extreme concern today.

Other factors that always have to be considered in the selection of a vacuum pump system besides the lower horsepower requirements are purchase price, total installation cost, maintenance, seal water requirements, amount of liquid with incoming air flow, and presence of contamination such as solids or fibers. In other words, one type of vacuum pump may look good from a horsepower standpoint, but because of the above other considerations, may not be practical or the total system cost is much more expensive than using another type pump.

In considering the above parameters, an important balancing criteria is based upon sufficient power to permit the use of a felt for dewatering purposes over the longest possible time before replacement is required. It is well known that the felt will wear over a period of time in use and will ultimately have to be replaced. However, the felt also undergoes a reduction in permeability as it is used over a period of time for dewatering purposes. This reduction in permeability naturally affects the efficiency of the dewatering system. Consequently, it has been the policy to use a vacuum pump of substantial horsepower in the dewatering system so that the felts can be used for a longer period of time even after its permeability has been substantially reduced during use. It can be readily observed that the larger horsepower vacuum pump is considerably oversized for the system when the felt is new causing the system to be inefficient and expensive during a substantial portion of the time a new felt is employed until the permeability has been reduced sufficiently for the additional horsepower to be needed.

Alternatively, felts can be more frequently replaced but this is also a costly and time consuming procedure which is undesirable in the industry.

It should also be noted that even with the oversized vacuum pump in regard to horsepower, the additional horsepower is often not sufficient to effectively dewater with the use of a single suction pump and a fixed slot width. It has been shown that increased dwell time is also an effective means of efficiently dewatering as well as increasing the pressure differential.

SUMMARY OF THE INVENTION

With the above background in mind, it is among the primary objectives of the present invention to provide a constant flow felt dewatering system where vacuum pump requirements are minimized, particularly in regard to horsepower requirements. Vacuum pump sizing is based upon a single suction pipe under new felt conditions.

It is an objective of the present invention to provide a system whereby the felt is subjected to a longer dwell time over suction pipe slots thereby increasing the efficiency of the system and achieving a greater dewatering effect.

A further objective is to provide a system whereby two spaced slotted suction pipes are provided and conduit means from each pipe to a centrifugal exhauster or other known type of blower means that can be substituted therefor. The felt is designed to pass over the suction pipes and one of the suction pipes has a control valve automatically operated by a controller responsive to horsepower which changes as a function of the air flow through the exhauster. An increase in air flow results in higher exhauster drive horsepower.

One way of accomplishing the control means adjustment is by providing an adjustable control valve responsive to an electrical actuator which in turn is responsive to an electrical controller connected to the drive motor for the centrifugal exhauster. A change in horsepower is sensed by the controller which in turn operates the electrical actuator to automatically adjust the control valve and accordingly adjust the flow applied to one of the suction pipes.

In the system described above, when a new felt is used at start up, the control valve is closed or nearly closed so that only one suction pipe is connected to the centrifugal exhauster and all or virtually all dewatering is through the slot or slots of that suction pipe. As the felt permeability decreases, the air flow to the exhauster also decreases which results in lower drive horsepower since horsepower is a function of flow with an exhauster. The controller senses the lower power and through the electrical actuator opens the adjustable control valve to the second suction pipe. In this manner, the felt is dewatered at two locations when it passes over the first suction pipe and thereafter when it passes over the second suction pipe with the now open conduit system. In one operable design of the system, by the time the felt permeability reaches approximately 50% of original value of the new felt, the control valve is wide open.

In this type of system, minimum vacuum pump requirements are present since the sizing of the vacuum pump or centrifugal exhauster is based upon minimum dwell time requirements under new felt conditions. When the felt becomes more difficult to dewater, that is of lower permeability, the dwell time is increased.

Dwell time is the time the felt or a given particle of felt is over the open slot. An increase in dwell time may be accomplished by either increasing the slot width or decreasing the speed of felt travel. One way this can be accomplished is by using a single suction pipe with a predetermined slot configuration under new felt conditions. When the felt becomes old, a second slot configuration is used which may include at least a second suction pipe.

In a further embodiment of the system utilizing the centrifugal exhauster and the two suction pipes, the suction through the second pipe is regulated by the use of an adjustable slot in that pipe. An appropriate mechanism is used to automatically open and close the slot and that mechanism is responsive to a controller which in turn is responsive to a change in horsepower applied to the centrifugal exhauster. Once again, it has been found effective to use an electrical system whereby an electrical motor is attached to the adjustable slot and is electrically connected to a controller responsive to a change in horsepower by appropriate electrical connections. Alternatively a pneumatic or mechanical system can be used in place of an electrical system.

In use, in start up with a new felt utilized in the system, the adjustable slot of one of the two suction pipes is at its minimum width. This provides for maximum dewatering effect through the other suction pipe by means of the centrifugal exhauster and minimal dewatering with regard to the suction pipe containing the adjustable slot. Thereafter, as the felt permeability decreases in use, the air flow to the centrifugal exhauster also decreases. This results in lower drive horsepower since horsepower is a function of flow with a centrifugal exhauster. The control senses the lower power and actuates the motor to automatically open the adjustable slot and allow more air flow to the second of the two suction pipes. The parameters of the system can be adjusted accordingly and it has been found effective to provide a system wherein by the time felt permeability reaches approximately 50% of the original value of the new felt the adjustable slot will be equal to the non-adjustable slot in the other suction pipe.

Once again, minimum vacuum pump requirements are achieved since the sizing is based upon primarily on a single suction pipe utilized under new felt conditions. The second suction pipe only comes into significant operation after the felt permeability decreases. In all of the embodiments of the present invention, the system is designed so that minimum horsepower can be used for the centrifugal exhauster and when permeability decreases for the felt during use, the efficiency is maintained due to the use of a second suction pipe. Adjustment of the suction applied to the second suction pipe is coordinated with reduction in felt permeability during prolonged lifetime use of the felt in the dewatering system.

A substantially constant flow felt dewatering system is provided. The system includes a first and second suction pipe with each suction pipe having at least one slot therein. A felt is positioned to pass over the slots of the first and second suction pipes. Vacuum means is connected to the first and second suction pipes by conduit means. Drive means operates the vacuum means to apply vacuum to the first and second suction pipes and to advance the felt over the pipes whereupon vacuum is applied thereto to dewater the felt. Control means is provided responsive to a change in felt conditions to vary the dwell time of felt with respect to the slots.

In summary, the system involves increasing the dwell time from new felt conditions to old felt conditions. This involves sensing change in air flow and providing slot adjustment and/or arrangement to maintain a substantially constant flow through felt life.

With the above objectives among others in mind, reference is made to the attached drawings.

DETAILED DESCRIPTION

Figure 1:
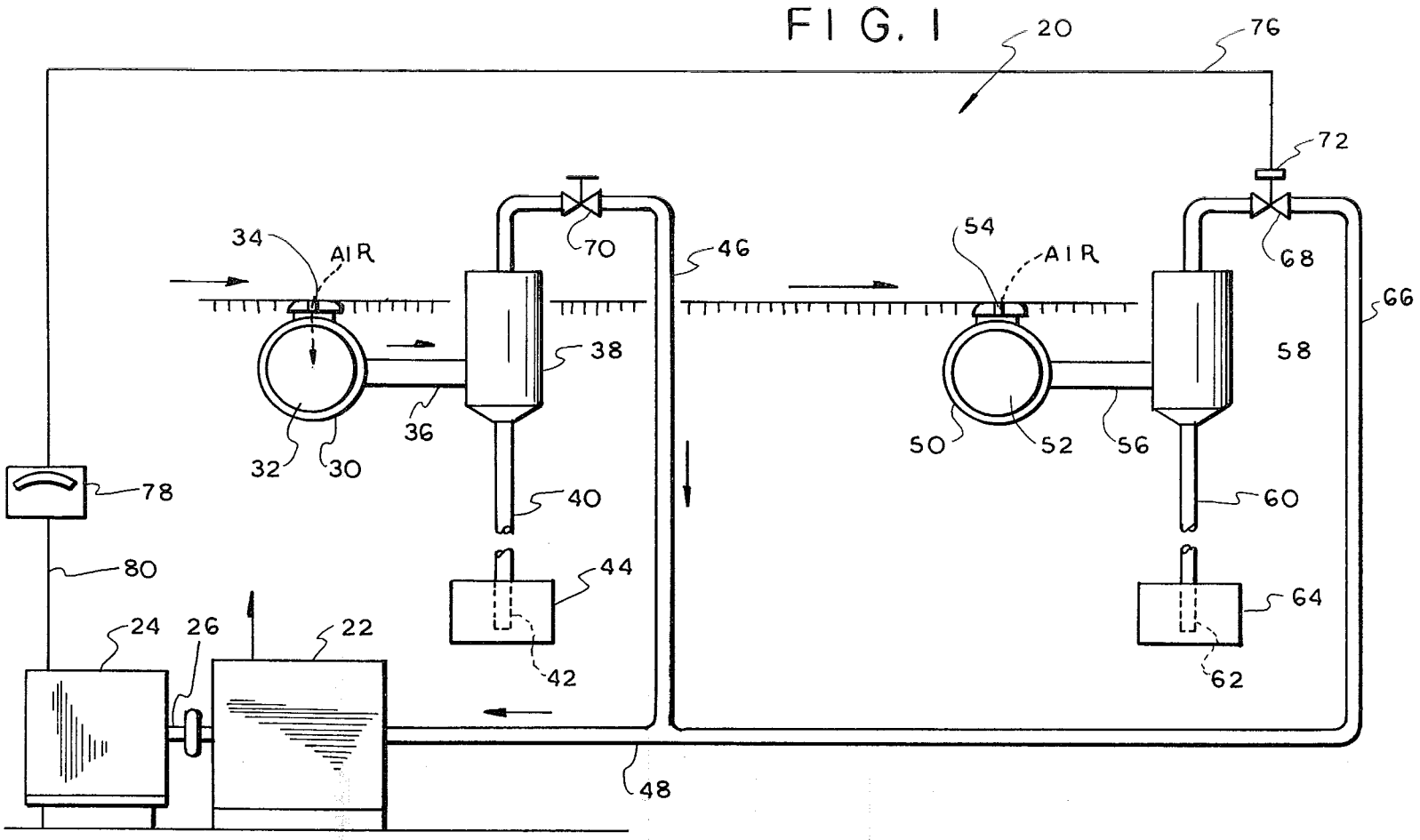
FIG. 1 is a schematic view of the dewatering system of the invention with a new felt in use and with arrows showing the direction of fluid flow.
Figure 2:
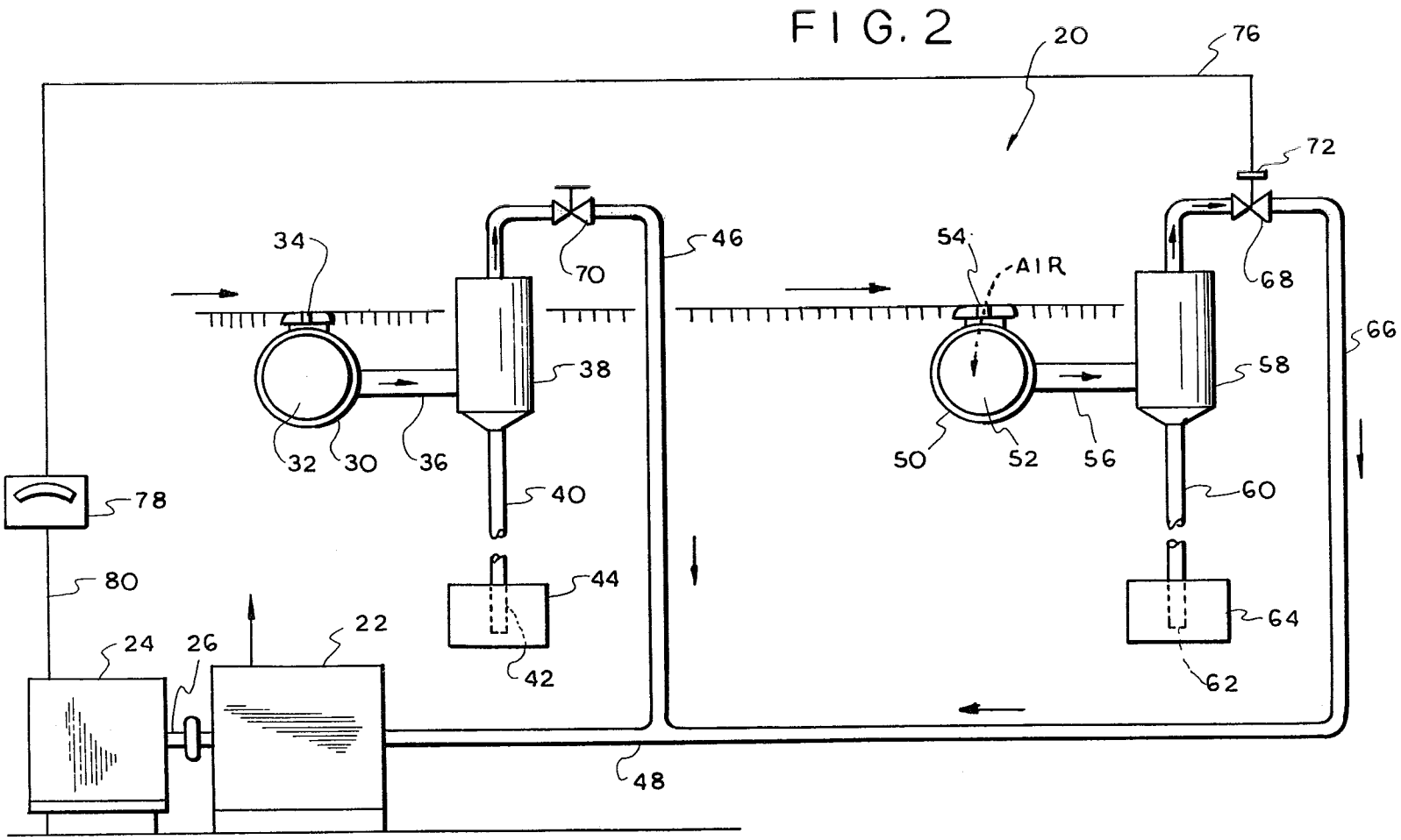
FIG. 2 is a schematic view of the dewatering system of FIG. 1 after the felt has been used until it has a substantially reduced permeability with arrows showing the direction of fluid flow.

Constant flow felt dewatering system 20, as depicted in FIGS. 1 and 2, shows the operation of the system with a new felt in FIG. 1 and with an older felt of reduced permeability in FIG. 2.

System 20 includes a conventional well known type of centrifugal exhauster or other common type of blower or vacuum pump that is a well known substitute therefor. An example is a centrifugal exhauster manufactured by HOFFMAN Air and Filtration System of Syracuse, N.Y. Typical flow rates would be in the range of 2000–7000 ACFM.

A conventional felt used in the papermaking industry is passed through the system for dewatering purposes. Arrows show the direction of movement of the felt from left to right as FIG. 1 is viewed. A conventional well known drive mechanism (not shown) can be used to advance the felt. Near the beginning of the system is a first suction pipe 30 with a hollow interior 32 and open at its upper end through a suction pipe slot 34. The suction pipe slot 34 is open to the felt passing thereover. Suction pipe 30 is mounted in the system in a conventional manner. Extending laterally from suction pipe 30 is a conduit 36 which communicates with the hollow interior 32 thereof. The other end of conduit 36 communicates with the hollow interior of separator 38. A drop leg 40 extends downwardly from separator 38 and terminates at an open end 42. The open end 42 communicates with the interior of a reservoir 44.

Extending from the upper end of separator 38 is a conduit 46 which communicates with the interior thereof and extends into communication with a conduit 48. Conduit 48 is connected to centrifugal exhauster or multi-stage blower 22.

Beyond suction pipe 30 in the direction of the felt travel is a second suction pipe 50. Suction pipe 50 has a hollow interior 52 and an upwardly extending slot 54 communicating with the hollow interior 52 and with the passing felt. A lateral conduit 56 extends from suction pipe 50 to a hollow separator 58 and communicates with the interior of the separator and the hollow interior 52 of suction pipe 50. Separator 58 has a drop leg 60 extending downward with its open bottom end 62 in communication with a collection reservoir 64. Conduit 66 communicates with the interior of separator 58 and extends into integral communication with conduit 48 and thereby into communication with centrifugal exhauster 22.

An adjustable control valve 68 is mounted in conduit 66 and a throttling valve 70 is mounted in conduit 46. Control valve 68 is electrically operated and for this purpose a conventional electric actuator 72 is connected to control valve 68. Actuator 72 is connected by electrical line 76 to an amp controller 78 which is electrically connected by electrical line 82 to motor 24. This system could be pneumatically or otherwise operated instead of electrically.

In operation, FIG. 1 shows the system 20 at the time of start up when a new felt is introduced to the system to travel in the direction of the arrows. At start up with the new felt, control valve 68 is closed thereby closing the conduit pathway between suction pipe 50 and centrifugal exhauster 22. Alternatively, the valve 68 can be slightly open without materially affecting the operation of the system. Thus, there is no air flow or virtually no air flow through the system as shown by the absence of arrows along conduit 66.

On the other hand, throttling valve 70 is fully open and air flow is drawn through slot 34 of suction pipe 30 into the hollow interior 32 of the pipe along with water removed from the felt passing over the slot. This combination of air and water than passes through conduit 36 into separator 38 where the water is removed in conventional fashion and passes through drop leg 40 into reservoir 44. The air continues its travel through conduit 46 and conduit 48 into the centrifugal exhauster 22 and is exhausted therefrom to atmosphere. This is shown by the arrows in FIG. 1.

As time passes in use of the felt and the felt permeability decreases the air flow to the exhauster 22 also decreases. This results in lower drive horsepower since horsepower is a function of flow with an exhauster. Accordingly, controller 78 senses the lower power and causes electrical actuator 72 to open valve 68. This is the condition shown in FIG. 2. Control valve 68 is opened gradually in response to the changing horsepower condition until, by the time the felt permeability reaches approximately 50% of the original permeability value of the new felt, the control valve is wide open. This procedure for opening the valve has been found to be most effective for purposes of system 20. However, the electrical controls can be adjusted accordingly to open the valve at any desired rate in response to horsepower change which is related to permeability of the felt.

As shown in FIG. 2, air and water is still drawn through slot 34 into the hollow interior of suction pipe 32 from where it passes to separator 38 and the air thereafter passes through conduits 46 and 48 to the exhauster 22. Additionally, air and water passes from the felt through slot 54 into the hollow interior 52 of the second suction pipe 50. The combined air and water then passes through conduit 56 into separator 58. The water is separated in conventional fashion from the air in separator 58 and passes through drop leg 60 into reservoir 64. The air continues through open valve 68 and through conduit 66 into conduit 48 and into the centrifugal exhauster 22 for exhaust to atmosphere. This flow with regard to suction pipes 30 and 50 is shown by arrows in FIG. 2.

As discussed above, the advantages of this system include the ability to use minimum vacuum pump requirements since sizing is based upon a signal suction pipe under new felt conditions. When the felt is more difficult to dewater, that is when the permeability is decreased, the advantage of increased dwell time is achieved in view of the travel path across two suction pipes.

Figure 3:
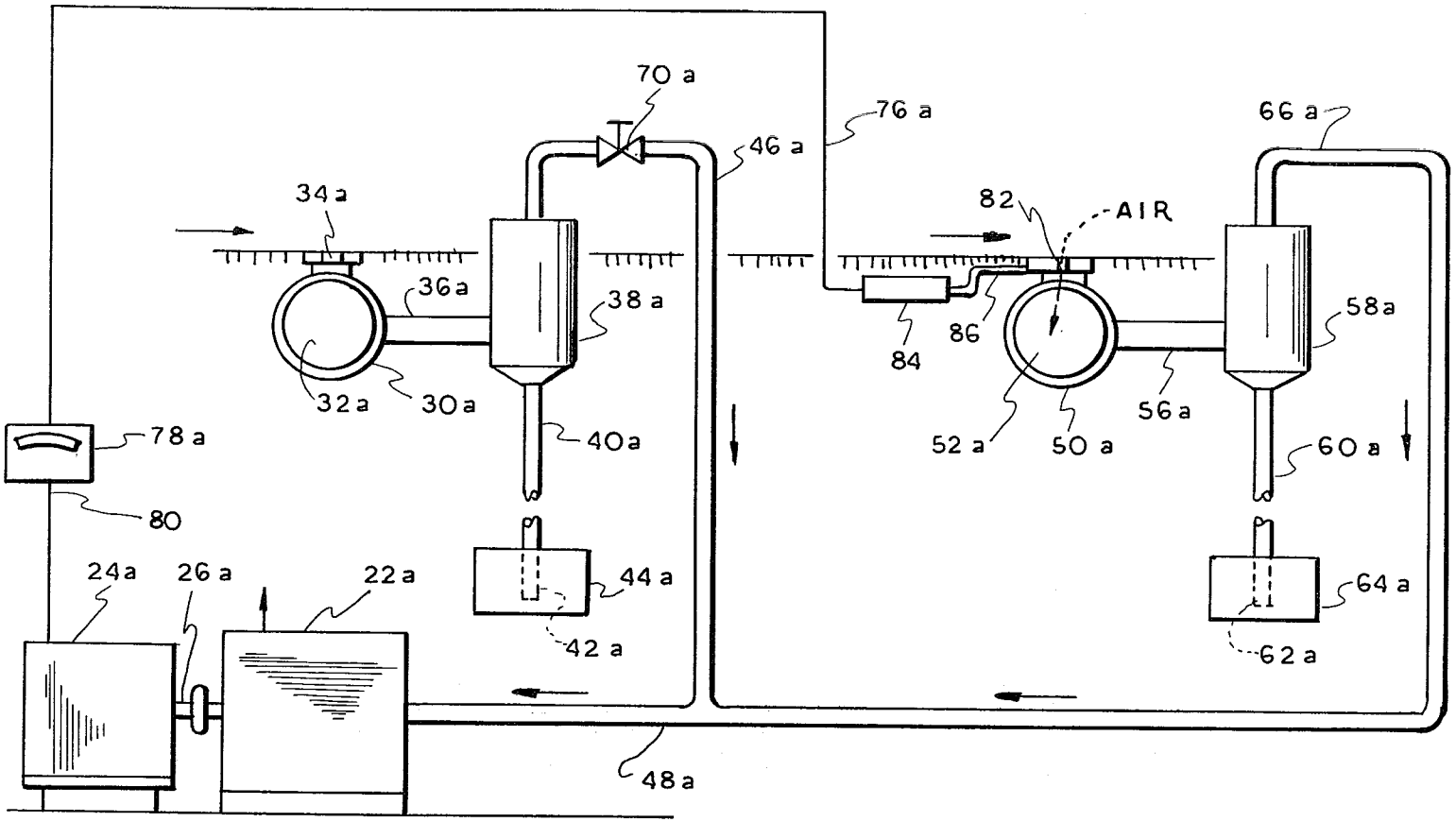
FIG. 3 is a schematic view of an alternative embodiment of the dewatering system of the invention with arrows showing the direction of fluid flow when a new felt is in use.
Figure 4:
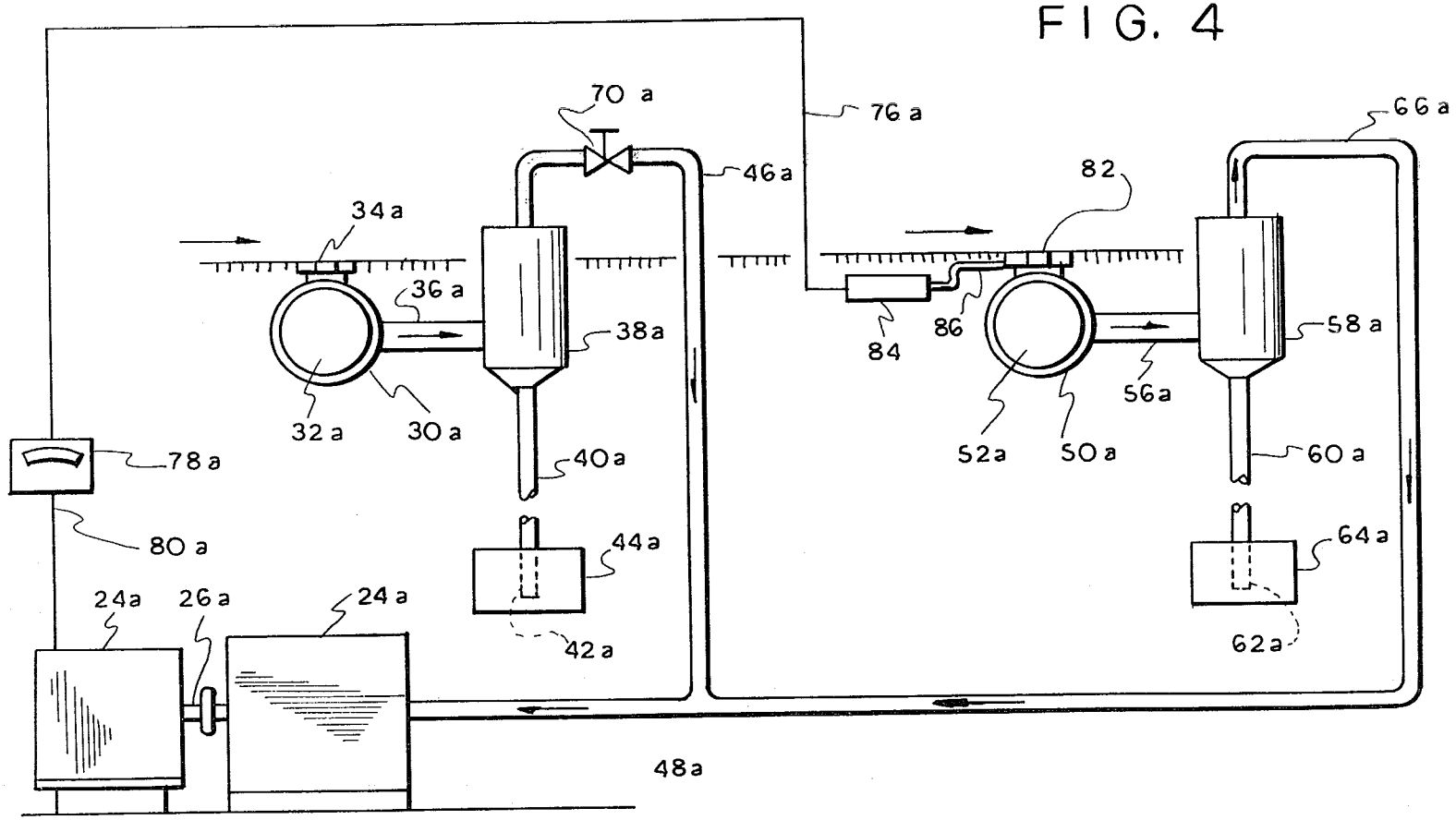
FIG. 4 is a schematic view thereof with arrows showing the direction of fluid flow when the felt has been in use for a sufficient length of time so as to have a substantially reduced permeability.

An alternative arrangement of the present invention is depicted in FIGS. 3 and 4. The majority of the components are the same as discussed above in connection with the embodiments of FIGS. 1 and 2 and thus similar components are given the same numbers with the addition of the subscript a.

The modifications relate to the controls for the second suction pipe 50*a*. In place of the fixed width slot 54 of the previously discussed embodiment, an adjustable slot 82 is utilized. The adjustable slot 82 is of a conventional well known type of mechanically shiftable aperture and enables one to vary the width of the slot as desired. For purposes of varying the width, a motor 84 is provided and is mechanically or electrically connected by connector 86 to the slot 82 so that when the motor is actuated the slot is adjusted in width. Electrical conduit 76*a* is connected to controller 78*a* and to motor 24*a*. In this embodiment, control valve 68 and the electrical actuator 72 are dispensed with.

FIG. 3 shows the embodiment in start up use with a new felt. Adjustable slot 82 is positioned at its minimum size width or opening. Thus, as the new felt passes in the direction shown by the arrows in FIG. 3, air passes through slot 34*a* into the hollow interior 32*a* of suction pipe 30*a*. It accumulates water as the felt is dewatered and the combination water and air passes through conduit 36*a* into separator 38*a* where the water is separated from the felt to pass through drop leg 40*a* into the reservoir 44*a*. The air passes through conduit 46*a* with valve 78 open and thereafter through conduit 48*a* as shown by the arrows into centrifugal exhauster 22*a*.

At the same time, air passes through the felt at the location of minimum width slot 82 and accumulates a minimum amount of water. The combination enters the hollow interior 52*a* of the second suction pipe 50*a* and thereafter through conduit 56*a* into separator 58*a*. Separated water passes through drop leg 60*a* to accumulate in reservoir 64*a*. The air passes from the step of separator through conduit 66*a* and conduit 48*a* into the centrifugal exhauster 22*a* for exhausting to atmosphere. The arrows of FIG. 3 show this combined air flow with respect to suction pipes 30*a* and 50*a*.

As felt permeability decreases the air flow to the exhauster also decreases. This results in lower drive horsepower as with the previous embodiment since horsepower is a function of flow with an exhauster. Controller 78*a* senses the lower power and actuates motor 24*a* to open the adjustable slot 82 and allow more air flow into the hollow interior 52*a* of the second suction pipe 50*a*. The rate of opening of the slot is a matter of choice as with the adjustable control valve of the previously discussed embodiment and can be opened gradually in response to a gradual change in permeability of the felt. It has been found effective to use a rate of opening of the slot which results in a condition wherein by the time felt permeability reaches approximately 50% of its original value the adjustable slot will be equal to the size of slot 34*a* in the first suction pipe 30*a*. This condition is depicted in FIG. 4 with arrows showing the continuous air flow with respect to both suction pipes and the enlarged width of adjustable slot 82. In connection with this embodiment as with the previous embodiment, the object is to maintain the constant air flow to the exhauster and this is facilitated by the additional slot exposure for the felt with reduced permeability. The flow path as shown by the arrows are the same in FIG. 4 as in FIG. 3 with the difference being in the amount of air flow through slot 82. WIth its widened slot additional space is provided for the combined air and water from the felt to pass. Air flow continues to the separators and through the interconnected conduits from the two separators back to the exhauster 22*a* where it is exhausted to atmosphere.

Once again, dwell time is the time the felt or a given particle of felt is over the open slot. An increase in dwell time may be accomplished by either increasing the slot width or decreasing the speed of felt travel. One way this can be accomplished is by using a single suction pipe with a predetermined slot configuration under new felt conditions. When the felt becomes old, a second slot configuration is used which may include at least a second suction pipe.

Naturally when the felt is to be replaced the above discussed embodiments are returned to the initial structural set up as shown in FIGS. 1 and 3 for both discussed embodiments. At this time, the new felt is introduced and start up conditions are produced. The cycle repeats and, as the felt's permeability decreases, the conditions shown in FIGS. 2 and 4 are arrived at for both discussed embodiments.

In the depicted embodiments the fixed condition suction pipe is positioned before the adjustable condition suction pipe in the direction of travel. Naturally, it would be possible to reverse or otherwise rearrange the relative positioning of the pipes.

The control means for all of the embodiments of the invention to maintain the substantially constant flow can be either an automatic or manual system.

This same system can be applied to other industries dealing with carpets, woven and non-woven products and textiles which utilize vacuum dewatering procedures and exhibit wide variations in permeabilities.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A substantially constant flow felt dewatering system comprising; at least one suction pipe having at least one slot therein, a felt positioned to pass over the at least one slot, vacuum means including a centrifugal pump where the drive horsepower for the pump is proportional to the air flow at the pump, conduit means connecting the at least one suction pipe to the vacuum means, means to advance the felt over at least one pipe wherein vacuum is applied thereto to dewater the felt, means for sensing the drive horsepower and means responsive to the sensed horsepower for automatically controlling the air flow through the suction pipes to cause slot width adjustment and/or arrangement to vary the dwell time in order to maintain a substantially constant air flow under varying vacuum conditions.

2. A constant flow felt dewatering system comprising; a first suction pipe having a slot therein, a second suction pipe having a slot therein, a felt positioned to pass over the slots of the first and second suction pipes, vacuum means including a centrifugal pump where the drive horseposer for the pump is proportional to the air flow at the pump, conduit means connecting the first and second suction pipes to the vacuum means, means to advance the felt over the pipes whereupon suction is applied thereto to dewater the felt, means for sensing the drive horsepower and means responsive to the sensed horsepower for automatically controlling the air flow through the suction pipes to vary the dwell time of the felt with respect to the slots in order to maintain a substantially constant air flow under varying vacuum conditions.

3. The invention in accordance with claim 1 wherein the control means is an automatic control valve positioned in the conduit means between a second suction pipe and the vacuum means, an actuator connected to the control valve, and wherein the horsepower sensing means is operatively connected to the centrifugal pump drive means and the actuator.

4. The invention in accordance with claim 2 wherein the conduit means between the first suction pipe and the vacuum means further includes a separator for removing water from the air drawn through the felt and the slot in the first suction pipe, a drop leg from the separator to a reservoir for collection of the removed water, and a throttling valve to enable control of the flow through the conduit means between the first suction pipe and the vacuum means.

5. The invention in accordance with claim 2 wherein the second suction pipe has means for adjusting the slot width, slot drive means attached to said adjusting means to automatically open and close the slot as desired, said sensing means operatively connected to the slot centrifugal drive means and to the pump drive means.

6. The invention in accordance with claim 5 wherein the slot drive means is a motor.

7. The invention in accordance with claim 5 wherein the slot width of the adjustable slot in the second suction pipe is designed to be equal to the size of the slot of the first suction pipe when the felt permeability reaches approximately 50% of the felt permeability of the felt when new.

8. The invention in accordance with claim 5 wherein the conduit means between the first suction pipe and the vacuum means further includes a separator to facilitate separation of the water from the air after the air passes through the felt and removes water therefrom, a drop leg extending from the separator into a reservoir to collect the separated water, and a throttling valve in the conduit means to enable control of the flow through the conduit means between the first suction pipe and the vacuum means.

9. The invention in accordance with claim 4 wherein the conduit means between the second suction pipe and the vacuum means further includes a separator to separate water from air passed through the felt and a drop leg extending from the separator into communication with a reservoir to collect the separated water.

10. A method of providing a substantially constant flow felt dewatering system comprising; providing at least one suction pipe having at least one slot therein, connecting the at least one suction pipe to a source of vacuum including a centrifugal pump with a drive horsepower for the pump is proportional to the air flow at the pump to apply suction to the at least one suction pipe, advancing a felt over the at least one slot of the at least one pipe whereupon suction is applied thereto to dewater the felt, sensing the drive horsepower and automatically controlling the slot width adjustment and/or arrangement in response to the sensed horsepower to vary the dwell time in order to maintain a substantially constant air flow under varying vacuum conditions.

11. A method of providing a constant flow felt dewatering system comprising; arranging a first suction pipe having a slot therein and a second suction pipe having a slot therein in predetermined position with respect to one another, connecting the first and second suction pipes by conduits to vacuum means including a centrifugal pump where the drive horsepower for the pump is proportional to the air flow at the pump for applying suction to the first and second suction pipes, advancing a felt over the slots of the pipes whereupon suction is applied thereto to dewater the felt, sensing the drive horsepower and automatically controlling air flow through the suction pipes in response to the sensed horse power to vary the dwell time of the felt with respect to the slots such that a constant air flow is maintained under varying vacuum conditions.

12. The invention in accordance with claim 11 wherein the suction is controlled by an automatic control valve and the conduit between the second suction pipe and the vacuum means, an actuator for the control valve, whereby the sensed change in horsepower actuates the actuator to adjust the control valve and correspondingly change the airflow and suction applied to the slot of the second suction pipe.

13. The invention in accordance with claim 12 wherein the control valve is initially closed at the time of use of a new felt, and upon decrease of felt permeability during use and corresponding decrease in the air flow to the vacuum means resulting in a lower drive horsepower, sensing the lower horsepower and in response to the sensed lower horsepower the actuator opens the control valve and the conduit to the second suction pipe so that suction is applied to the slot of the second suction pipe as well as the slot of the first suction pipe.

14. The invention in accordance with claim 13 wherein the control valve is in the fully open position when the felt permeability reaches approximately 50% of the permeability value of the new felt.

15. The invention in accordance with claim 11 wherein the suction at the second suction pipe is controlled by an adjustable slot on the second suction pipe and slot drive means attached to the slot to automatically open and close the slot in response to the sensed change in drive horsepower.

16. The invention in accordance with claim 15 wherein the slot drive means for the second suction pipe is an electrical motor and the adjustable slot is at its minimum opening when a new felt is used in the system and as the permeability of the felt decreases the resultant drive horsepower for the vacuum means is sensed whereupon the electrical motor is activated to open the adjustable slot of the second suction pipe permitting more air to flow therethrough.

* * * * *